United States Patent [19]

Cervantes

[11] 4,222,677

[45] Sep. 16, 1980

[54] TOOL FOR THE DETAILED APPLICATION OF A FLUENT MATERIAL

[76] Inventor: Victoria Cervantes, 5538 Capellina Way, Santa Barbara, Calif. 93111

[21] Appl. No.: 22,795

[22] Filed: Mar. 22, 1979

[51] Int. Cl.[3] ..... A46B 11/00

[52] U.S. Cl. ..... 401/129; 132/88.7

[58] Field of Search ..... 401/6, 129, 183–186; 132/88.7, DIG. 3; 128/233, 215

[56] References Cited

U.S. PATENT DOCUMENTS

| | | | |
|---|---|---|---|
| 1,813,359 | 7/1931 | Priest | 401/6 |
| 3,312,255 | 4/1967 | Miller | 128/233 X |
| 3,764,221 | 10/1973 | Solenghi | 401/129 |
| 4,165,755 | 8/1979 | Cassai | 132/88.7 |

FOREIGN PATENT DOCUMENTS

| | | | |
|---|---|---|---|
| 1253384 | 1/1961 | France | 401/6 |
| 346962 | 3/1937 | Italy | 128/233 |
| 986478 | 3/1965 | United Kingdom | 128/215 |
| 1459859 | 12/1976 | United Kingdom | 401/129 |

*Primary Examiner*—John D. Yasko
*Attorney, Agent, or Firm*—Jack C. Munro

[57] ABSTRACT

A tool for the detailed application of a fluent material which takes the form of an elongated bent handle section with the handle section terminating in a brush section. During the applying of the fluent material, because of the bent handle section, the applier's hand does not obscure the application of the fluent material.

1 Claim, 3 Drawing Figures

Fig. 1
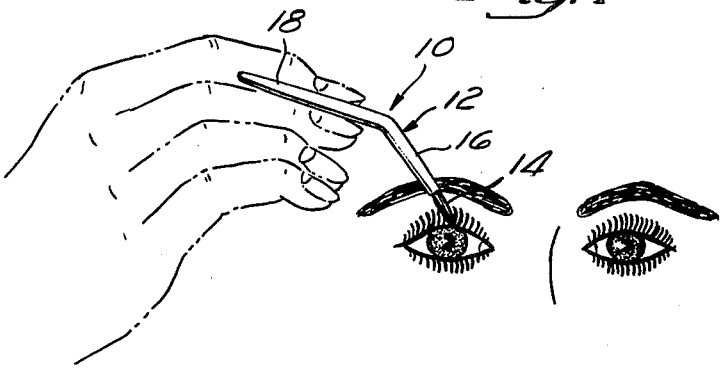
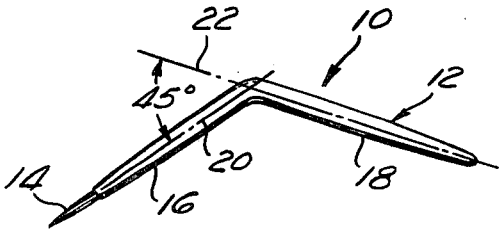
Fig. 2
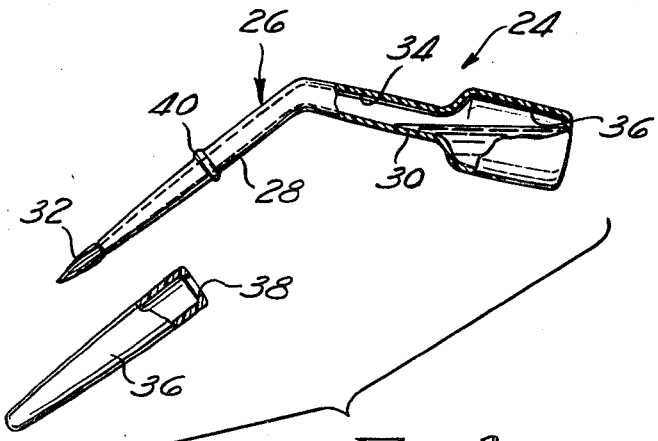
Fig. 3

TOOL FOR THE DETAILED APPLICATION OF A FLUENT MATERIAL

BACKGROUND OF THE INVENTION

The field of this invention relates to a tool for the applying of a fluent material. Specifically, the tool of this invention has been found to be most useful in the field of applying cosmetics such as mascara, lipstick, eyeliners and lid liners. However, it is considered to be in the scope of this invention that the field could include any detailed application of fluent material such as would be required in the painting of pictures.

The use of a small tipped brush to facilitate the application of a fluent or semi-fluent substance is well known. Such brushes have been in use for a substantial period of time and normally take the form of a straight handle section to which a small grouping of brushes are attached at the tip of the handle section. The brush is then used in a normal manner by playing the tip of the brush into contact with a fluent or semi-fluent substance and then by the stroking of the brush at the desired location, the fluent or semi-fluent structure is then distributed on the desired location.

Prior to this invention, all known brushes were constructed to include a straight handle. Inherently, during use of the brush, the user's hand would be located directly between the user's eyes and the area of application. This means that the user's hand automatically obscures the vision of the user. This means that the user's hand interferes with the detailed applying of the substance. It is quite common for "mistakes" to be made in the applying of the substance with the substance being applied to an undesirable location. These mistakes are facilitated due to the fact that the user is not able to clearly see the area of application.

SUMMARY OF THE INVENTION

The structure of this invention constitutes the modifying of a conventional brush so as to include an annular shaped handle section. When the brush is grasped, automatically the person's hand is displaced from the line of sight of the user to the tip of the brush. The brush can still be operated in the normal manner to produce the desired fine detail of applying of the fluent or semi-fluent material. Since the user's vision is not obscured, the applying of the substance can be completed in fine detail.

BRIEF DESCRIPTION OF THE DRAWING

FIG. 1 is a schematic view of the first embodiment of the brush of this invention showing its use as a cosmetic applying tool;

FIG. 2 is an elevational view of the first embodiment of the brush of this invention clearly depicting its angularly formed handle section; and FIG. 3 is a partly-in-cross-section, elevational view of the second embodiment of the brush of this invention showing its cooperation with a cover for the brush.

DETAILED DESCRIPTION OF THE SHOWN EMBODIMENTS

Referring particularly to FIGS. 1 and 2 of the drawing, there is shown the first embodiment 10 of this invention which takes the form of an elongated handle section 12 and a tip section 14. The handle section 12 is divided into a fore handle section 16 and an aft handle section 18. The brush 14 is fixedly secured to the outermost extremity of the fore section 16. It is to be understood within the first embodiment 10 that the handle section 12 is deemed to be solid and can be constructed of any rigid material such as wood, metal or plastic and the brush 14 can be composed of a plurality of conventional bristles or could be constructed of a foam plastic material or could be constructed of another similar material.

The fore section 16 includes a longitudinal center axis 20. The brush section 14 also has a longitudinal center axis which coincides with the center axis 20.

The handle section 18 also has a longitudinal center axis 22. As is readily apparent from the drawing, the center axes 20 and 22 are angularly disposed in respect to each other. The preferable angle of the angular disposition is forty-five degrees. However, it is considered to be within the scope of this invention that any angle between forty-five degrees and ninety degrees would be satisfactory.

Because of the bending of the handle section 12, the brush section 14 can be used to apply a fluid or semi-fluid substance in a very detailed manner such as in the applying of mascara or eyelid liner to a person's eyes as is shown within FIG. 1 of the drawing. In the applying of this cosmetic, the user observes the application by means of a mirror. If it were not for the angular disposition of the handle section 12, the user's hand would tend to obscure the applying of the cosmetic. As a result, using the embodiment 10 of this invention, the user can precisely apply the fluid or semi-fluid material at an exact location.

Referring particularly to FIG. 3 of the drawing, there is shown a second embodiment 24 of this invention which is basically similar to the first embodiment 10 as it includes a handle section 26 which is divided into a fore section 28 and an aft section 30. A brush 32 is fixedly secured to the outer end of the fore section 28. However, within the second embodiment 24, the handle section 26 includes a hollow passage 34. The rearwardmost portion of the hollow section 34 connects with a storage chamber 36. Within the storage chamber 36 is to be located a quantity of the fluid or semi-fluid material which is then to be conducted through the handle section 26 in contact with the brush 32. By incorporating of the reservoir within the tool 24, it is not necessary to constantly "dip" the brush 32 into contact with the quantity of fluid or semi-fluid material.

It is to be noted that the handle section 26 is to be angularly bent at the preferable angle of forty-five degrees as is shown within the first embodiment. Also, when the brush 32 is not is use, it is desirable for such to be closed through the use of a cover or cap 36. This cover or cap 36 has an access opening 38 through which the brush 32 is to be conducted. The wall surface around the access opening 38 is to be forced over annular bead 40 formed on the handle section 28. This functions to securely lock the cover or cap 36 in place.

What is claimed is:

1. A tool for the detailed application of a fluent material comprising:

an elongated handle section;

a tip section attached to an outer extremity of said handle section, said tip section comprising a brush, said tip section having a first longitudinal center axis;

said handle section formed into a fore portion and an aft portion, said fore portion having a second longitudinal center axis, said aft portion having a third longitudinal center axis, said tip section attached to said fore portion with said first and second longitudinal center axes coinciding, said third longitudinal center axis being angularly disposed at approximately forty-five degrees relative to said second longitudinal center axis, whereby upon said aft section being grasped and fluent material being applied by said brush, said tip section is readily observable through a mirror and not obscured by the user's hand;

said handle section being hollow, said brush connecting with said hollow, whereby fluent material is to be conducted through said hollow into contact with said brush to therefore be applied by said brush; and said tip section including an annular bead, a cap to be located over said brush, said cap including an access opening, said access opening to forcibly engage with said annular bead to tightly connect said cap to said tip section, said cap being manually removable from said tip section to expose said brush.

* * * * *